US008750729B2

(12) United States Patent
Isobe

(10) Patent No.: US 8,750,729 B2
(45) Date of Patent: Jun. 10, 2014

(54) IMAGE FORMING APPARATUS

(75) Inventor: Yuta Isobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 126 days.

(21) Appl. No.: 13/316,396

(22) Filed: Dec. 9, 2011

(65) Prior Publication Data

US 2012/0155891 A1 Jun. 21, 2012

(30) Foreign Application Priority Data

Dec. 17, 2010 (JP) ..... 2010-282236

(51) Int. Cl.
*G03G 15/08* (2006.01)

(52) U.S. Cl.
USPC ..... 399/12; 399/27; 399/61

(58) Field of Classification Search
USPC ..... 399/12, 27, 61
See application file for complete search history.

(56) References Cited

U.S. PATENT DOCUMENTS

| | | | | |
|---|---|---|---|---|
| 7,991,315 | B2 * | 8/2011 | Kawamura et al. | 399/61 |
| 2012/0148278 | A1 * | 6/2012 | Isobe | 399/53 |

FOREIGN PATENT DOCUMENTS

| | | | |
|---|---|---|---|
| CN | 1235288 | A | 11/1999 |
| CN | 1658085 | A | 8/2005 |
| CN | 1670633 | A | 9/2005 |
| CN | 101221393 | A | 7/2008 |
| CN | 101334614 | A | 12/2008 |
| JP | 2001-117362 | A | 4/2001 |
| JP | 2009-009035 | A | 1/2009 |

* cited by examiner

*Primary Examiner* — David Gray
*Assistant Examiner* — Michael Harrison
(74) *Attorney, Agent, or Firm* — Canon U.S.A., Inc., IP Division

(57) ABSTRACT

An image forming apparatus includes a developing unit with a supply roller that supplies toner to a developing roller located such that of a contact region between the developing roller and the supply roller, the uppermost stream position in the rotating direction of the supply roller during image formation is located higher than the lowermost stream position, wherein the supply roller rotates in a reverse direction during image formation if the developing unit is new.

3 Claims, 7 Drawing Sheets

IMAGE FORMING APPARATUS

BACKGROUND OF THE INVENTION

1. Field of the Invention

The present invention relates to an image forming apparatus that forms a latent image on an image bearing member by using, for example, an electrophotographic system or an electrostatic recording system, and that develops the latent image to form a visual image.

2. Description of the Related Art

Known electrophotographic image forming apparatuses sometimes use a developing unit having a developing roller serving as a toner bearing member that develops an electrostatic latent image and a supply roller serving as a toner supply member that rotates with the developing roller in contact therewith to thereby supply toner to the developing roller. The supply roller generally has a urethane sponge layer, which is a foamed layer, on the surface thereof to hold the toner to be supplied to the developing roller. An example of such a developing unit is disclosed in Japanese Patent Laid-Open No. 2009-009035. FIG. 7 shows the developing unit disclosed in Japanese Patent Laid-Open No. 2009-009035, in which a developing roller 1 and a supply roller 2 having a urethane sponge layer 2*b* is shown.

With the configuration using the toner supply member having a foamed layer, as described above, in the case where the developing unit is new, sufficient image density sometimes cannot be obtained because the foamed layer does not contain a sufficient amount of toner. Therefore, in the case where the developing unit is new, it is necessary to first rotate the toner supply member for a long time to soak the foamed layer with toner before image formation. Accordingly, in the case where a new developing unit is used, it sometimes takes much time to bring it into an image formable state.

SUMMARY OF THE INVENTION

The present invention has been made in consideration of the foregoing problems. An aspect of the present invention provides an image forming apparatus that quickly brings a developing unit, even if it is new, into an image formable state by soaking a foamed layer thereof with toner.

According to an aspect of the present invention, an image forming apparatus includes an image bearing member configured to bear an electrostatic latent image, a developing unit that includes a container that stores toner, a toner bearing member configured to bear the toner and to develop the electrostatic latent image with the toner, and a toner supply member located, inside the container, in contact with the toner bearing member, the toner supply member having a foamed layer on its surface and being configured to rotate in a predetermined direction during image formation to supply the toner to the toner bearing member, wherein, of the contact region with the toner bearing member, an uppermost stream position in the predetermined direction is higher than a lowermost stream position, and a detecting unit configured to detect whether the developing unit is new, wherein if the detecting unit detects that the developing unit is new, the toner supply member rotates in a reverse direction to the predetermined direction before the first image formation by the developing unit.

Further features of the present invention will become apparent from the following description of exemplary embodiments with reference to the attached drawings.

DESCRIPTION OF THE EMBODIMENTS

An image forming apparatus according to an aspect of the present invention will be described in more detail below based on the drawings. It is to be understood that the scope of the present invention is not limited to the sizes, materials, shapes, the relative positions, etc. of components described in the embodiment unless otherwise stated.

1. Overall Schematic Configuration of Image Forming Apparatus

Figure 1:
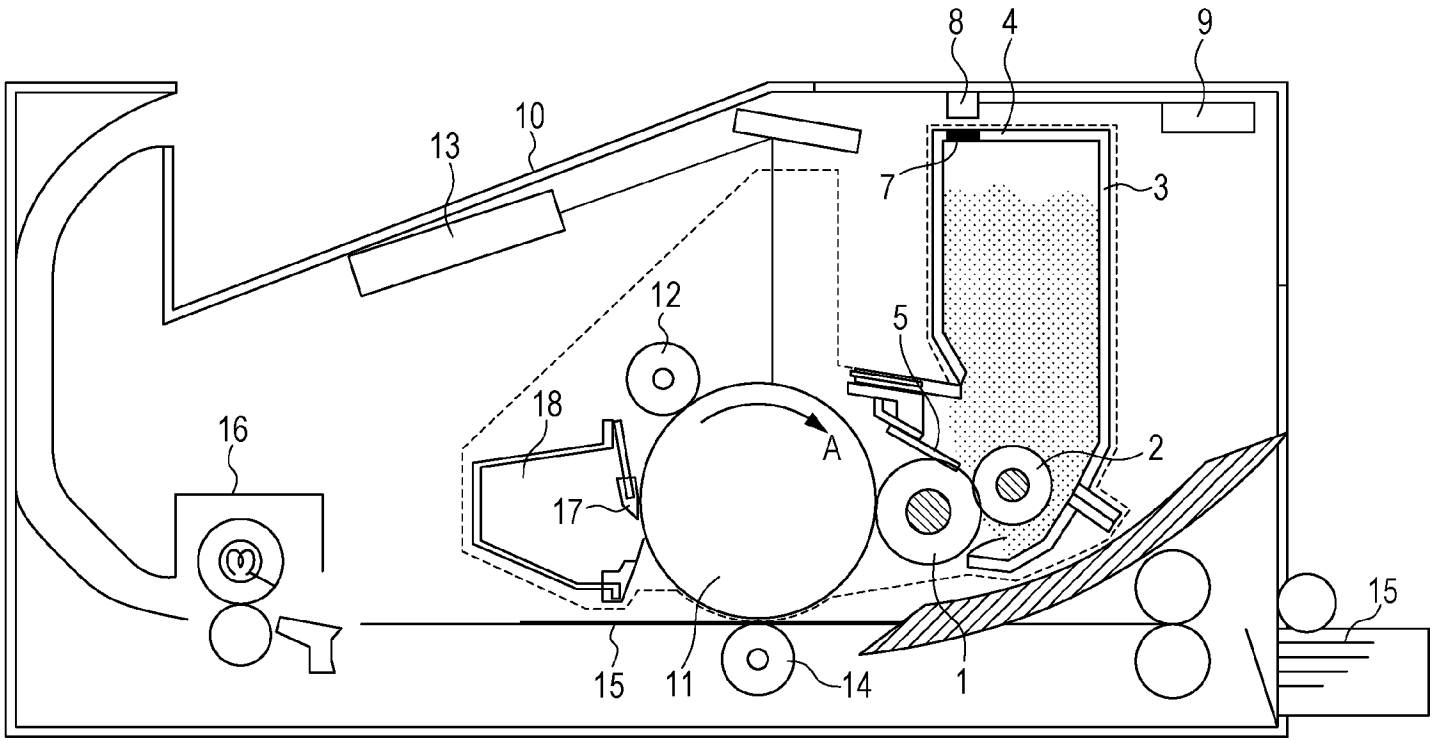
FIG. 1 is a schematic cross-sectional view of an image forming apparatus according to an embodiment.

FIG. 1 is a schematic cross-sectional view of an image forming apparatus 10 to which the present invention is applied. The outline of an image forming process in the image forming apparatus 10 will be described. The operations of the image forming apparatus 10 are controlled by a control circuit unit 9 (controller unit).

In FIG. 1, a photosensitive drum 11 serving as an electrostatic-image bearing member rotates in the direction of arrow A. First, the photosensitive drum 11 is uniformly charged by the charging roller 12 serving as a charging unit. Thereafter, the photosensitive drum 11 is exposed to laser light from a laser optical unit 13 serving as an exposing unit, and an electrostatic latent image is formed on the surface thereof. This electrostatic latent image is developed by a developing unit 4 and is visualized as a toner image. The visualized toner image on the photosensitive drum 11 is transferred onto a recording sheet 15 serving as a transfer material by a transfer roller 14. Toner remaining on the photosensitive drum 11 after transfer is scraped by a cleaning blade 17 serving as a cleaning member and is accommodated in a waste-toner container 18. The cleaned photosensitive drum 11 repeats the forgoing operation for image formation. The recording sheet 15 to which a toner image is transferred is subjected to fixing by a fixing unit 16 and is then discharged outside the apparatus.

2. A Series of Operations for Print Job Processing of Image Forming Apparatus

Figure 2:
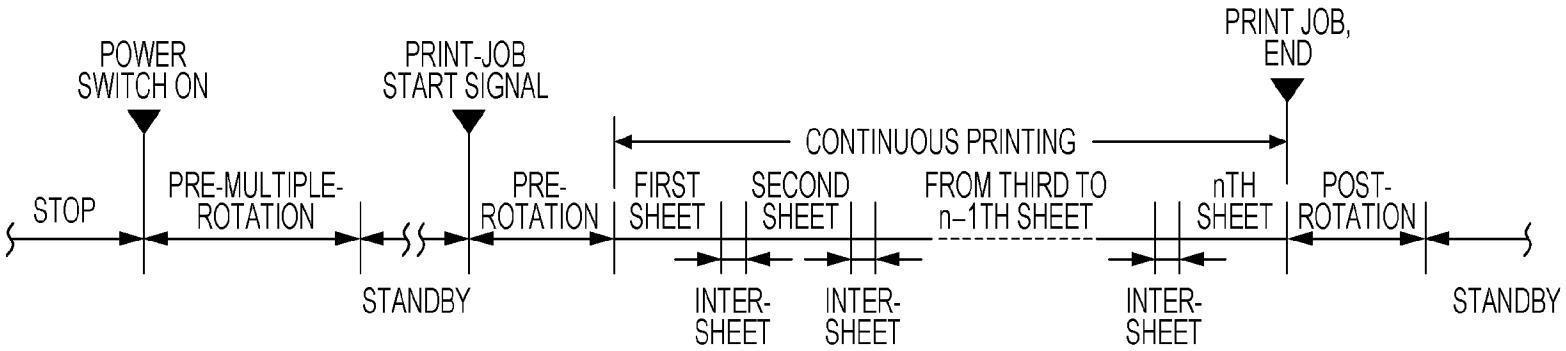
FIG. 2 is a schematic diagram showing a series of operations for print job processing of the image forming apparatus of this embodiment.

Next, a series of operations from activating the image forming apparatus to performing image formation to shifting to a standby mode will be described using FIG. 2.

2.1 Pre-Multiple-Rotation Operation

Starting (activating, warming) operations are executed when a main body power switch (not shown) is switched from off to on. The motor is started to execute necessary preparatory operations for processing units.

2.2 Standby

The driving of the motor is stopped after the predetermined starting operations are finished, and the standby mode is kept until a print-job start signal is input.

2.3 Pre-Rotation Operation

Upon receiving the print-job start signal, the motor is started again to execute necessary preparatory operations for processing units. More specifically, the operation is executed as follows: a. a print-job start signal is received, b. an image is expanded using a formatter, c. the pre-rotation operation is performed. In the case where a print-job start signal is input during the pre-multiple-rotation operation of 2.1, the process shifts to the pre-rotation operation without the standby of 2.2 after the end of the pre-multiple-rotation operation.

2.4 Execution of Print Job (Image Forming Operation)

After the predetermined pre-rotation operation is finished, the above-described image forming process is executed, and the image-formed recording sheet 15 is output. For a continuous print job in which a plurality of recording sheets are printed, the above-described image forming process is repeated, so that a predetermined number of image-formed recording sheets are output in sequence.

2.5 Inter-Sheet Operation

Inter-sheet operation is a process for the interval between the trailing end of one recording sheet 15 and the leading end of the next recording sheet 15 in a continuous print job, during which no sheet is passed through the transfer portion and the fixing unit 16.

2.6 Post-Rotation Operation

For a print job of only one sheet, post-rotation is a process for executing necessary post job operations for the processing units by continuing to drive the motor after the image-formed recording material is output, i.e., after the print job is finished. For a continuous print job, post-rotation is a process for executing necessary post job operations for the processing units by continuing to drive the motor after the last image-formed recording material is output, i.e., after the print job is finished.

2.7 Standby

After the predetermined post-rotation operation is finished, the driving of the motor is stopped, and the image forming apparatus is held in a standby mode until the next print-job start signal is input.

3. Configuration of Developing Unit

Figure 3:
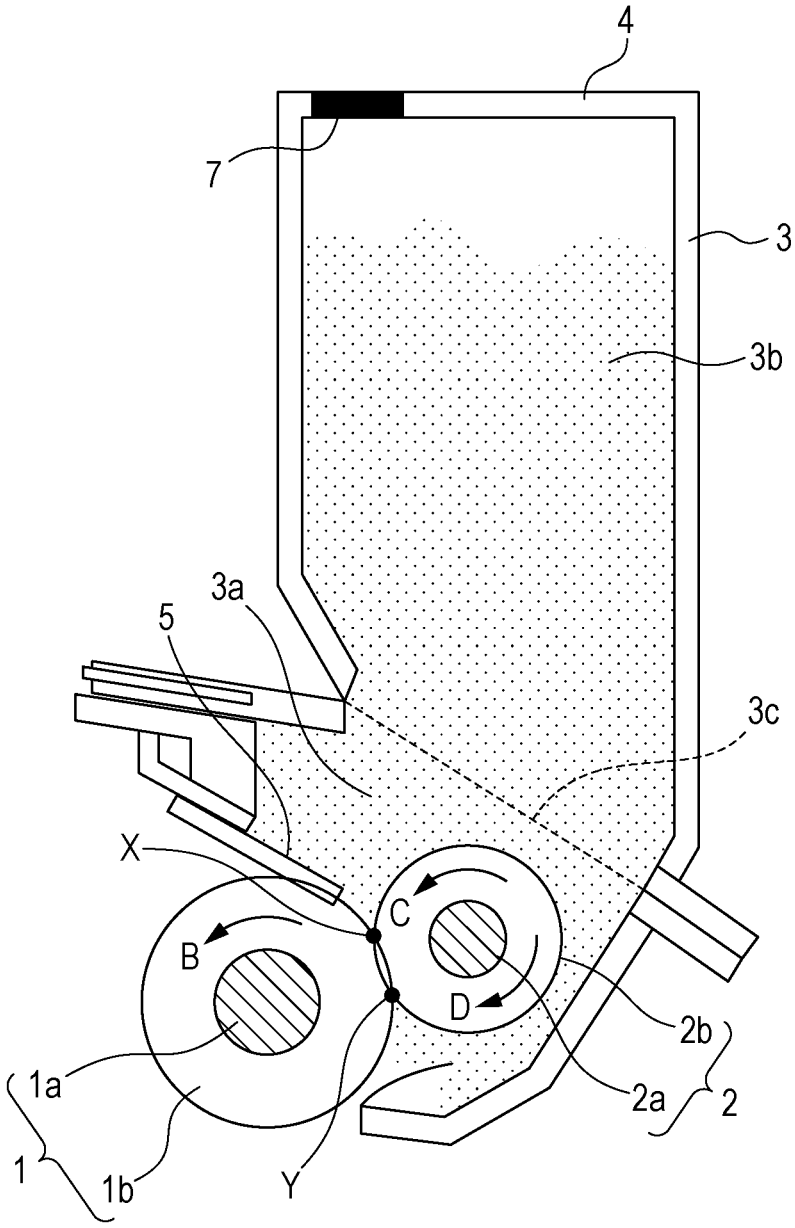
FIG. 3 is a schematic cross-sectional view showing a developing unit of this embodiment.

Next, the developing unit 4 will be further described with reference to FIG. 3.

The developing unit 4 includes a developer container 3 in which toner is stored, a developing roller 1 serving as a toner bearing member that bears and conveys the toner to an electrostatic latent image, a supply roller 2 serving as a toner supply member that supplies the toner to the developing roller 1, an elastic blade 5 serving as a regulation member that regulates the layer thickness of the toner applied to the developing roller 1, and a memory 7 serving as a storage unit in which information on whether the developing unit 4 is new is stored.

The developing roller 1 is disposed in an opening of the developer container 3 so as to apply pressure to the photosensitive drum 11. The developing roller 1 is constituted by an 8-mm-diameter conductive shaft 1*a* made of stainless steel, an aluminum alloy or the like, and a conductive elastic layer 1*b* made of silicone rubber formed therearound as a base layer. The surface is coated with an acryl urethane rubber layer. The developing roller 1 has an outside diameter of 12 mm and a volume resistance of about 10E5 Ω·cm. The developing roller 1 rotates in the direction of arrow B to supply the toner applied on the surface thereof to an electrostatic latent image on the photosensitive drum 11.

The supply roller 2 is disposed in the developer container 3 so as to apply pressure to the developing roller 1. The supply roller 2 is constituted by a 6-mm-diameter conductive shaft 2*a* made of stainless steel, an aluminum alloy, or the like, and a urethane sponge layer 2*b*, which is a foamed layer, formed therearound. The supply roller 2 has an outside diameter of 15 mm and a volume resistance of about 10E8 Ω·cm. The supply roller 2 is disposed such that the developing roller 1 pushes the urethane sponge layer 2*b* of the supply roller 2 at an intrusion of 1.0 mm (a length obtained by dividing the sum of the outside diameters of the supply roller 2 and the developing roller 1 by 2 and subtracting the length between the center of the shaft 1*a* and the center of the shaft 2*a* therefrom on a line segment connecting the centers). During image formation, the supply roller 2 rotates in the direction of arrow C (first rotating direction) to supply the toner on the surface of and inside the foamed layer 2*b* to the developing roller 1. Here, the supply roller 2 is disposed such that, of the contact portion with the developing roller 1, the uppermost stream position in the direction of C is higher than the lowermost stream position.

The elastic blade 5 is disposed such that one end thereof applies pressure to the developing roller 1. The elastic blade 5 is made of stainless steel, urethane rubber, or the like. The elastic blade 5 regulates the thickness of the toner layer on the developing roller 1 to a desired thickness with the end that pushes the developing roller 1.

The memory 7 is a non-contact nonvolatile memory. Specifically, the memory 7 has an antenna (not shown) serving as an information transfer unit at the memory 7 side and communicates wirelessly with a main-body-side information transfer unit 8 of the apparatus main body. The main-body-side information transfer unit 8 is disposed at a position facing the memory 7 in a state in which the developing unit 4 is installed in the apparatus main body. Thus, a control circuit unit 9 transmits and receives electrical information (reads and writes information from and to) to and from the memory 7 via the main-body-side information transfer unit 8. Here, the memory 7 stores new-developing-unit identifying information for determining whether the developing unit 4 is new. The control circuit unit 9 reads and writes the new-developing-unit identifying information via the main-body-side information transfer unit 8.

The developing unit 4 is equipped with a toner seal 3*c* serving as a detachable sealing member that isolates the toner in the developer container 3 from the developing roller 1 and the supply roller 2 to prevent the toner from leaking from a developing chamber 3*a* during transportation. The developing unit 4 is used after the toner in the container 3*b* becomes movable to the developing chamber 3*a* by having the toner seal 3*c* removed.

4. Driving Transfer Mechanism to Developing Unit

Figure 4:
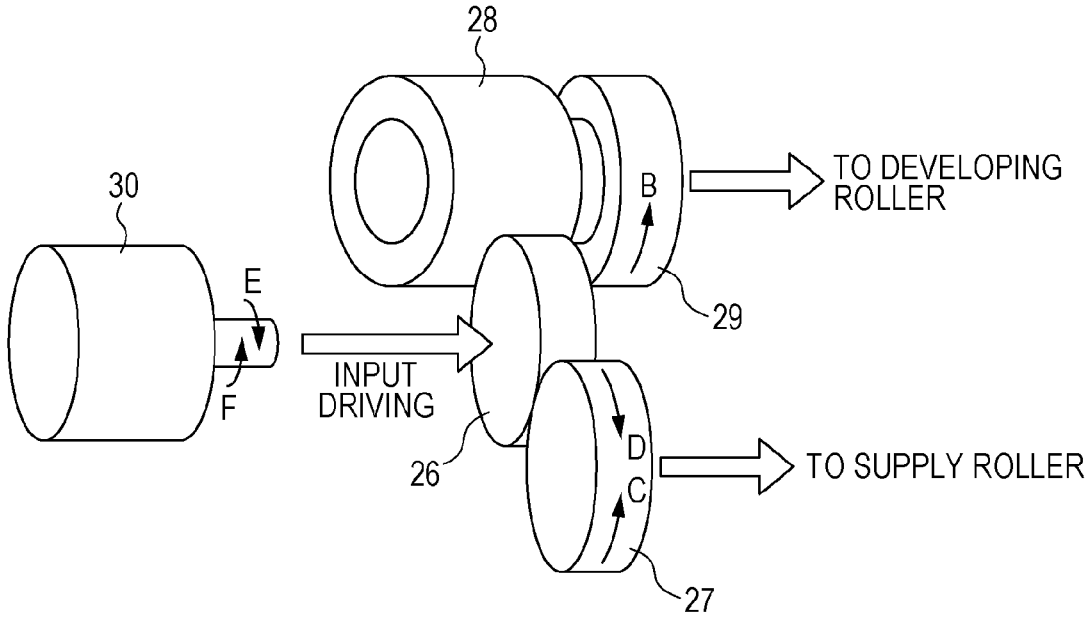
FIG. 4 is a schematic diagram showing transfer of driving from a motor to the developing unit of this embodiment.

Next, a mechanism for transferring driving from a motor 30 serving as a driving unit of the image forming apparatus to the developing roller 1 and the supply roller 2 of the developing unit 4 will be described using FIG. 4. The developing unit 4 has a coupling gear 26 that receives the driving from the motor 30. The developing unit 4 further has a supply gear 27 that transfers the driving to the supply roller 2, a one-way clutch 28 that transfers the driving to the developing roller 1, and a developing gear 29. The motor 30 can be rotated either in the direction of arrow E or in the direction of arrow F.

The motor 30 rotates in the direction of E during image formation. When the motor 30 rotates in the direction of E, the coupling gear 26 receives the driving from the motor 30, and the gear 27 of the supply roller 2, which is driven by the coupling gear 26, and the supply roller 2 are rotated in the direction of C. Furthermore, when the motor 30 rotates in the direction of E, the driving is also transferred to the one-way clutch 28 via the coupling gear 26. The one-way clutch 28 comes into engagement with the gear 29 of the developing roller 1 only when rotating in the direction of arrow B, which is a rotating direction during image formation, to transfer the driving to the gear 29, thereby rotating the developing roller 1 in the direction of B.

During a charging mode, described below, the motor 30 rotates in the direction of F opposite to that during image formation. When the motor 30 rotates in the direction of F, the coupling gear 26 receives the driving from the motor 30, and the gear 27 of the supply roller 2 is driven by the coupling gear 26, so that the supply roller 2 rotates in the direction of D at 135 rpm. When the motor 30 rotates in the direction of F, the one-way clutch 28 and the developing gear 29 do not come into engagement, so that the driving is not transferred to the developing gear 29 and the developing roller 1.

5. Charging Mode 5.1 Flow

Figure 5:
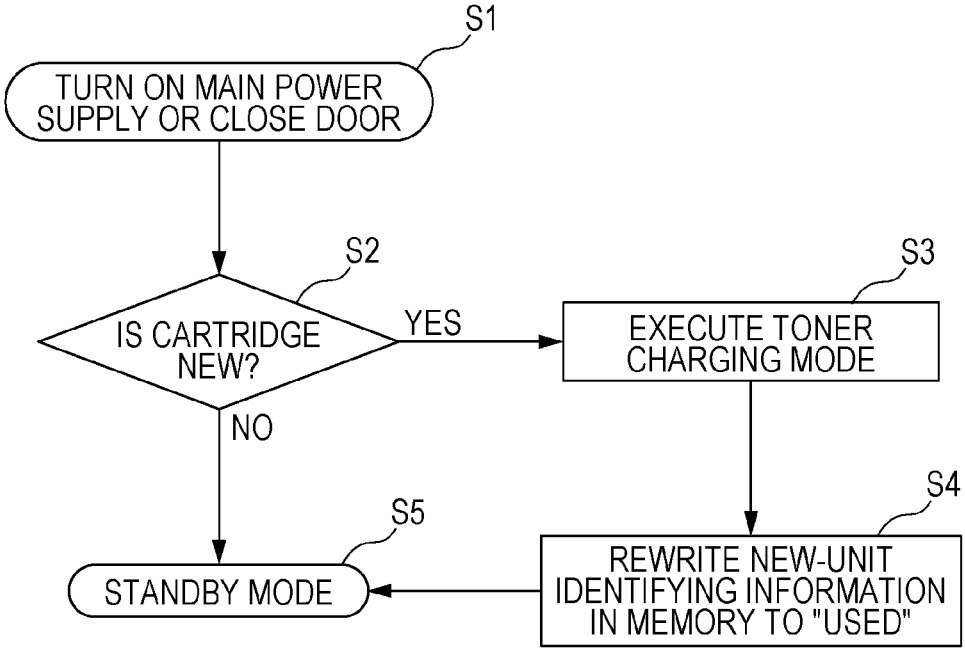
FIG. 5 is a flowchart for a toner charging mode of this embodiment.

Next, a charging mode will be described with reference to a flowchart in FIG. 5. FIG. 5 is a flowchart for the operation of the image forming apparatus shown in FIG. 1.

First, when the power of the image forming apparatus is turned on or a developing-unit replacing door is closed (S1), the control circuit unit 9 reads the information in the memory 7 via the main-body-side information transfer unit 8 and determines whether the developing unit 4 is new (S2).

If the developing unit 4 is not new, the image forming apparatus moves to a standby mode in which printing is possible (S5). If the developing unit 4 is new, the control circuit unit 9 executes a charging mode. Specifically, the motor 30 rotates in the direction of F, and the supply roller 2 rotates in the direction of D, opposite to that during image formation, for ten seconds (S3). Thereafter, the control circuit unit 9 writes the information that it is in use (not new) to the memory 7 via the main-body-side information transfer unit 8 (S4). Thereafter, the image forming apparatus moves to a standby mode in which printing is possible (S5).

5.2 Advantages and Mechanism

Figure 6:
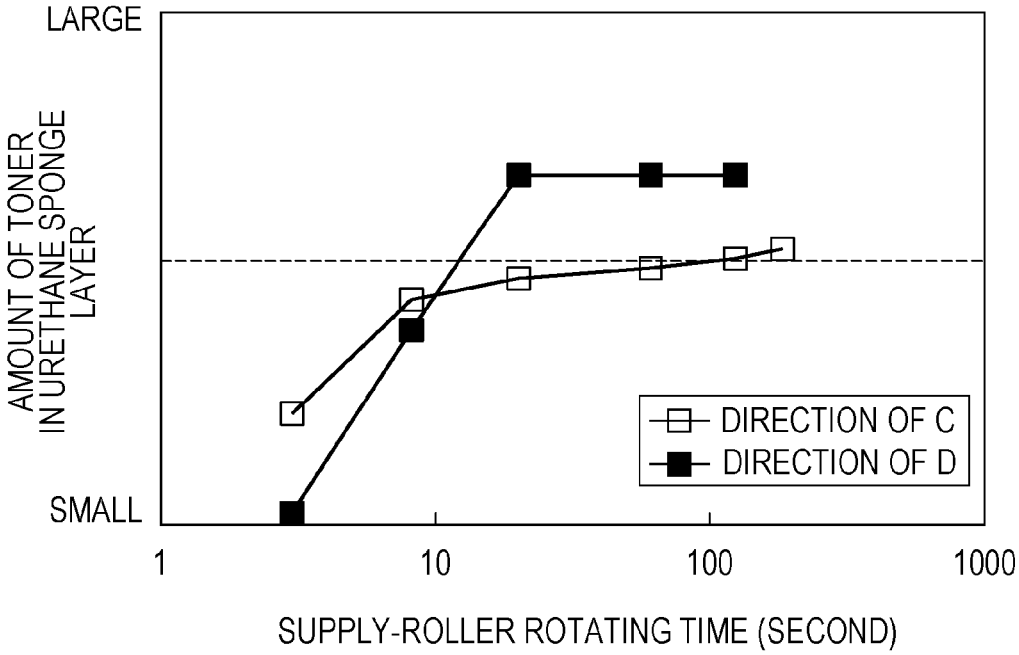
FIG. 6 is a graph showing the amount of toner contained in a urethane sponge layer plotted against the rotating time of the supply roller.
Figure 7:
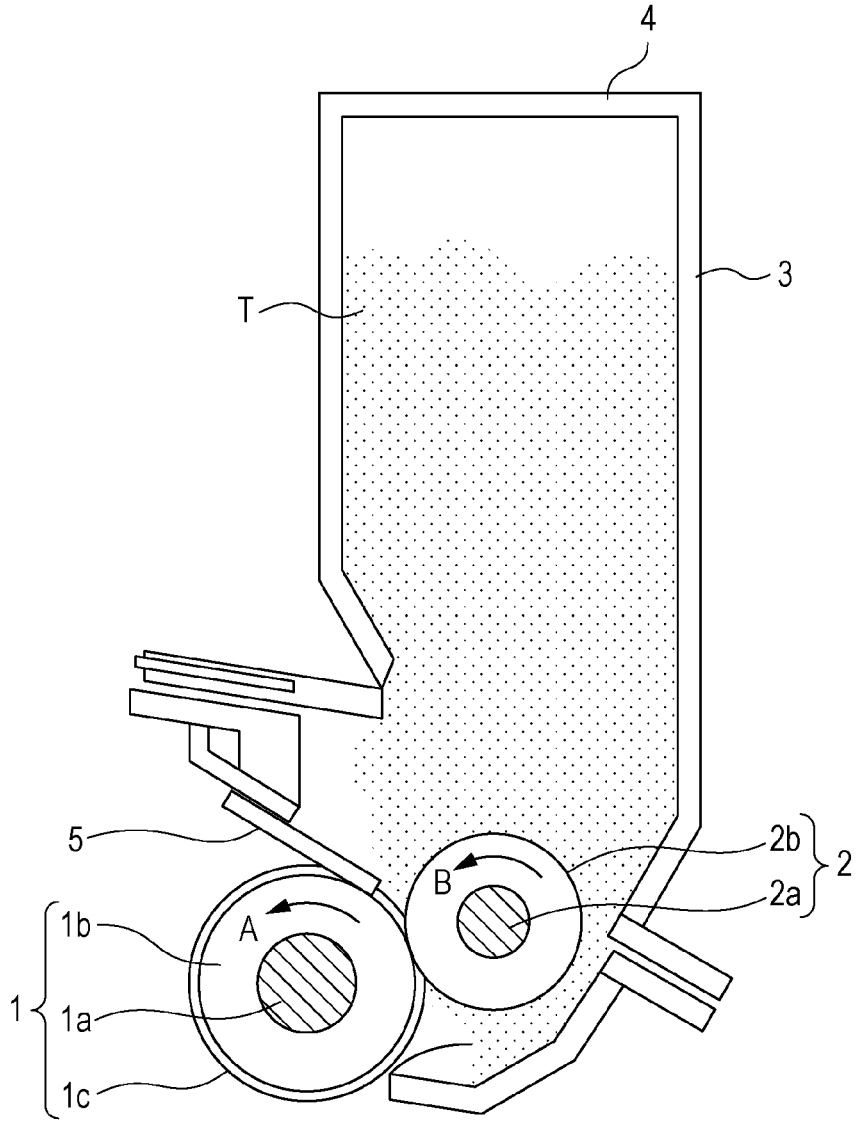
FIG. 7 PRIOR ART
FIG. 7 is a diagram showing a developing unit in related art.

FIG. 6 shows the relationship between the rotating time of the supply roller 2 and the amount of toner contained in the urethane sponge layer 2*b* in the case where the supply roller 2, in the new developing unit 4, directly after the toner seal 3*c* is removed, is rotated before the first image formation. In FIG. 6, a result in the case where the supply roller 2 is rotated in the direction of C, which is a rotating direction during image formation, is plotted by a thin solid line with void squares. A result when the supply roller 2 is rotated in the direction of D, which is opposite to that during image formation, is plotted by a thick solid line with filled squares. The amount of toner in the supply roller 2 at which a high-quality image can be printed is indicated by a dotted line. As shown in FIG. 6, 100-second rotation in the direction of C can ensure a sufficient amount of toner, while 10-second rotation in the direction of D can ensure a sufficient amount of toner. Thus, in the conventional approach, the supply roller 2 is rotated in the direction of C, which is a rotating direction for image formation, for an extended period of time before the first image formation is performed using the new developing unit 4 so as to soak the urethane sponge layer 2*b* with a sufficient amount of toner. In contrast, by executing the charging mode of the present embodiment, the urethane sponge layer 2*b* can be quickly soaked with a sufficient amount of toner, thus permitting the apparatus to quickly enter a printable state.

The mechanism for quickly soaking the urethane sponge layer 2*b* with a sufficient amount of toner using the charging mode of the present embodiment will be described below.

First, the transfer of toner to and from the urethane sponge layer 2*b* along with the rotation of the supply roller 2 will be described using FIG. 2. As described above, the supply roller 2 is disposed in pressure contact with the developing roller 1. Thus, when the supply roller 2 rotates in the direction of C, the urethane sponge layer 2*b* is compressed at a portion X (the contact region between the developing roller 1 and the supply roller 2, the uppermost stream position in the rotating direction C of the supply roller 2) at which the supply roller 2 begins to come into contact with the developing roller 1, so that the toner in the urethane sponge layer 2*b* is pushed out therefrom. The supply roller 2 further rotates so that the toner is supplied to the developing roller 1 at the nip between the supply roller 2 and the developing roller 1, and the urethane sponge layer 2*b* is released from the compression at a portion Y after passing through the nip (the contact region between the developing roller 1 and the supply roller 2, the lowermost stream position in the rotating direction C of the supply roller 2) and absorbs the toner on the developing roller 1 and the toner around the portion Y. In other words, the urethane sponge layer 2*b* absorbs the toner at the portion Y and discharges the toner at the portion X during image formation. By repeating such a process, image formation occurs by the supply roller 2 supplying toner to the developing roller 1.

When the supply roller 2 rotates in the direction of D opposite to that during image formation, as in the charging mode of the present embodiment, the urethane sponge layer 2*b* is compressed at the portion Y and released from the compression at the portion X. Thus, the urethane sponge layer 2*b* absorbs the toner at the portion X and discharges the toner at the portion Y. Since the portion X is disposed higher than the portion Y, the weight of the toner is placed more directly on the portion X than on the portion Y. Therefore, rotating the supply roller 2 in the direction D may further increase the force of absorbing the toner. Accordingly, rotating the supply roller 2 in the direction of D in FIG. 3 permits the urethane sponge layer 2*b* to be quickly soaked with toner C than in the direction of C.

Although the above-described embodiment provides detecting units (memory 7 and control circuit 9) for determining whether the developing unit 4 is new, the present invention is not limited to this method for determining whether the developing unit 4 is new. Any detection method, such as an optical sensor detects that a new developing unit is mounted in the image forming apparatus and that the shape of the developing unit has changed, or detects that a protrusion of the developing unit is removed after the initial operation, may be selected as appropriate.

In the above-described embodiment, although the charging mode is executed during pre-multiple-rotation, the present invention is not limited thereto. Specifically, in the case where it is determined that the developing unit 4 is new, the charging mode may be executed before the first image formation by the developing unit 4. In other words, no image formation is performed during a period after it is determined that the developing unit 4 is new until the execution of the charging mode is completed, and after completion of the charging mode, image formation is performed.

Although the above-described embodiment is provided with the toner seal 3*c*, the present invention can also be applied to a developing unit 4 which does not include the toner seal 3*c*, and where the supply roller 2 soaks in toner when it is new in the case where the urethane sponge layer 2*b* of the supply roller 2 is not filled with a sufficient amount of toner.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-282236 filed on Dec. 17, 2010, which is hereby incorporated by reference herein in its entirety.

What is claimed is:

1. An image forming apparatus comprising:

an image bearing member configured to bear an electrostatic latent image;

a developing unit including a container that stores toner, a toner bearing member configured to bear the toner and to develop the electrostatic latent image with the toner, and a toner supply member located, inside the container, in contact with the toner bearing member, the toner supply member having a foamed layer on its surface and being configured to rotate in a predetermined direction during image formation to supply the toner to the toner bearing member, wherein, of the contact region with the toner bearing member, an uppermost stream position in the predetermined direction is higher than a lowermost stream position; and a detecting unit configured to detect whether the developing unit is new, wherein if the detecting unit detects that the developing unit is new, the toner supply member rotates in a reverse direction to the predetermined direction before a first image formation by the developing unit.

2. The image forming apparatus according to claim 1, further comprising a single motor configured to rotate the toner bearing member and the toner supply member, wherein the single motor does not rotate the toner bearing member when rotating the toner supply member in the reverse direction to the predetermined direction.

3. The image forming apparatus according to claim 1, wherein the developing unit includes a detachable sealing member that isolates the toner in the container from the toner bearing member and the toner supply member, wherein the toner supply member rotates in the reverse direction to the predetermined direction after the sealing member is removed.

* * * * *